US009132529B2

(12) United States Patent
Stratton et al.

(10) Patent No.: US 9,132,529 B2
(45) Date of Patent: Sep. 15, 2015

(54) MEDIA BLAST NOZZLE WITH NON-METALLIC THREADS

(71) Applicant: United Technologies Corporation, Hartford, CT (US)

(72) Inventors: Eric W. Stratton, Mansfield, TX (US); Cynthia B. Natale, Mansfield, TX (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 14/099,508

(22) Filed: Dec. 6, 2013

(65) Prior Publication Data

US 2014/0162537 A1 Jun. 12, 2014

Related U.S. Application Data

(60) Provisional application No. 61/734,720, filed on Dec. 7, 2012.

(51) Int. Cl.
*B24C 5/04* (2006.01)

(52) U.S. Cl.
CPC ..... *B24C 5/04* (2013.01)

(58) Field of Classification Search
CPC ..... B24C 5/04; B24C 5/02; B24C 7/0084; B24C 7/0046; B24C 1/045; F16L 15/00; F16L 15/009; F16L 15/08; F16L 25/021; F16L 47/16
USPC ..... 451/102, 90, 38–40; 239/DIG. 19; 403/179
See application file for complete search history.

(56) References Cited

U.S. PATENT DOCUMENTS

| | | | | | |
|---|---|---|---|---|---|
| 1,238,672 | A | * | 8/1917 | Hopwood | 239/72 |
| 1,813,733 | A | * | 7/1931 | Freeman | 239/597 |
| 1,889,979 | A | * | 12/1932 | Falardeau | 451/102 |
| 1,927,573 | A | * | 9/1933 | Owens | 451/102 |
| 2,332,407 | A | * | 10/1943 | Spenle | 451/102 |
| 2,681,255 | A | | 6/1954 | Downey | |
| 2,789,458 | A | * | 4/1957 | Skeisvoll | 411/433 |
| 2,872,563 | A | * | 2/1959 | Thorp et al. | 219/75 |
| 3,032,930 | A | * | 5/1962 | Williams | 451/102 |
| 3,069,812 | A | * | 12/1962 | Shelton, V | 451/91 |
| 3,344,558 | A | * | 10/1967 | Kirkland | 451/102 |
| 3,608,136 | A | * | 9/1971 | Tripptrap | 425/466 |
| 3,705,693 | A | * | 12/1972 | Franz | 239/600 |
| 4,032,043 | A | | 6/1977 | Lajovic | |
| 4,253,610 | A | | 3/1981 | Larkin | |

(Continued)

OTHER PUBLICATIONS

Sponge-Jet, "Sponge-Jet Parts and Accessories", available from: <https://www.spongejet.com/wp-content/uploads/2013/03/Nozzles_and_Accessories_eng.pdf>, 1999-2008.

(Continued)

*Primary Examiner* — George Nguyen
(74) *Attorney, Agent, or Firm* — O'Shea Getz P.C.

(57) ABSTRACT

A media blast includes a nozzle body manufactured of a first material with a set of internal threads manufactured of a second material different than the first material. A media blast nozzle for a spray gun, the media blast nozzle includes a nozzle body manufactured of a first material, the nozzle body defines an axis; and an insert with a set of internal threads manufactured of a second material different than the first material, the insert located at least partially within the nozzle body.

14 Claims, 2 Drawing Sheets

(56) References Cited

U.S. PATENT DOCUMENTS

| | | | | | |
|---|---|---|---|---|---|
| 4,545,317 | A | * | 10/1985 | Richter et al. | 114/222 |
| 4,633,623 | A | * | 1/1987 | Spitz | 451/102 |
| 4,704,826 | A | * | 11/1987 | Kirkland | 451/76 |
| 4,815,241 | A | * | 3/1989 | Woodson | 451/102 |
| 4,913,353 | A | * | 4/1990 | Myers | 239/267 |
| 5,044,233 | A | * | 9/1991 | Tatsu et al. | 81/429 |
| 5,283,990 | A | | 2/1994 | Shank, Jr. | |
| 5,402,939 | A | | 4/1995 | Shank, Jr. | |
| 5,421,766 | A | | 6/1995 | Shank, Jr. | |
| 5,484,325 | A | | 1/1996 | Shank | |
| 5,524,829 | A | * | 6/1996 | Keim et al. | 239/533.15 |
| 5,704,825 | A | | 1/1998 | LeCompte | |
| 5,738,283 | A | * | 4/1998 | Potz et al. | 239/533.3 |
| 5,857,900 | A | * | 1/1999 | Shank, Jr. | 451/102 |
| 6,045,300 | A | | 4/2000 | Antoun | |
| 6,077,152 | A | | 6/2000 | Warehime | |
| 7,513,116 | B2 | | 4/2009 | Hebert | |
| 7,900,719 | B2 | * | 3/2011 | Yao | 175/320 |
| 7,922,565 | B2 | * | 4/2011 | Knisel et al. | 451/99 |
| 8,187,057 | B2 | | 5/2012 | Broecker | |
| 8,313,050 | B2 | * | 11/2012 | Hall et al. | 239/591 |
| 8,876,017 | B2 | | 11/2014 | Ekholm | |
| 2004/0226754 | A1 | * | 11/2004 | Nordfeldt | 175/320 |
| 2008/0128533 | A1 | * | 6/2008 | Gehrung | 239/348 |

OTHER PUBLICATIONS

Kennametal, "Abrasize Blast Nozzles", available from: <https://www.kennametal.com/content/dam/kennametal/kennametal/common/Resources/Catalogs-Literature/Advanced%20Materials%20and%20Wear%20Components/B-12-02861_KMT_Blast_Nozzles_Catalog_EN.pdf>, 2012.

* cited by examiner

MEDIA BLAST NOZZLE WITH NON-METALLIC THREADS

The present disclosure claims priority to U.S. Provisional Patent Disclosure Ser. No. 61/734,720 filed Dec. 7, 2012.

BACKGROUND

The present disclosure relates to a media blast system and more particularly to a nozzle therefor.

Abrasive blasting is forcibly propels a stream of abrasive material against a surface under high pressure to, for example, smooth a rough surface, roughen a smooth surface, shape a surface, or remove surface contaminants. A pressurized fluid, typically air, is used to propel the blasting material, often called the media.

Mobile abrasive blast systems are typically powered by a diesel air compressor to provide a large volume of high-pressure air to a single or multiple blast gun from which an operator directs the media. Over time, a media blast nozzle of the gun may seize onto the gun. This may complicate removal for normal maintenance checks of nozzle apertures and other wear surfaces.

SUMMARY

A media blast nozzle according to one disclosed non-limiting embodiment of the present disclosure includes a nozzle body manufactured of a first material with a set of internal threads manufactured of a second material different than the first material.

A further embodiment of the present disclosure includes, wherein the first material is a metallic material.

A further embodiment of any of the foregoing embodiments of the present disclosure includes, wherein the second material is a non-metallic material.

A further embodiment of any of the foregoing embodiments of the present disclosure includes, wherein the set of internal threads are retained to the nozzle body by pins.

A further embodiment of any of the foregoing embodiments of the present disclosure includes, wherein the first material is a metallic material and the second material is a non-metallic material.

A further embodiment of any of the foregoing embodiments of the present disclosure includes, wherein the set of internal threads is retained to the nozzle body by pins.

A further embodiment of any of the foregoing embodiments of the present disclosure includes, wherein the set of internal threads are molded to the nozzle body.

A further embodiment of any of the foregoing embodiments of the present disclosure includes, wherein the first material is a metallic material and the second material is a non-metallic material.

A further embodiment of any of the foregoing embodiments of the present disclosure includes, wherein the set of internal threads are formed by an insert retained to the nozzle body by pins.

A media blast nozzle for a spray gun, the media blast nozzle according to another disclosed non-limiting embodiment of the present disclosure includes a nozzle body manufactured of a first material, the nozzle body defines an axis; and an insert with a set of internal threads manufactured of a second material different than the first material, the insert located at least partially within the nozzle body.

A further embodiment of any of the foregoing embodiments of the present disclosure includes, wherein the insert is retained to the nozzle body by pins.

A further embodiment of any of the foregoing embodiments of the present disclosure includes, wherein the first material is a metallic material.

A further embodiment of any of the foregoing embodiments of the present disclosure includes, wherein the second material is a non-metallic material.

A further embodiment of any of the foregoing embodiments of the present disclosure includes, wherein the insert is retained to the nozzle body by pins.

A media blast nozzle for a spray gun, the media blast nozzle according to another disclosed non-limiting embodiment of the present disclosure includes a nozzle body manufactured of a first material, the nozzle body defines an axis; and an insert with a set of internal threads manufactured of a second material different than the first material, the insert located at least partially within the nozzle body; and a pin that extends through the nozzle body and at least partially into the insert.

A further embodiment of any of the foregoing embodiments of the present disclosure includes, wherein the transverse pin is directed toward the axis.

A further embodiment of any of the foregoing embodiments of the present disclosure includes, wherein the inset is located opposite an aperture of the nozzle body along the axis.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
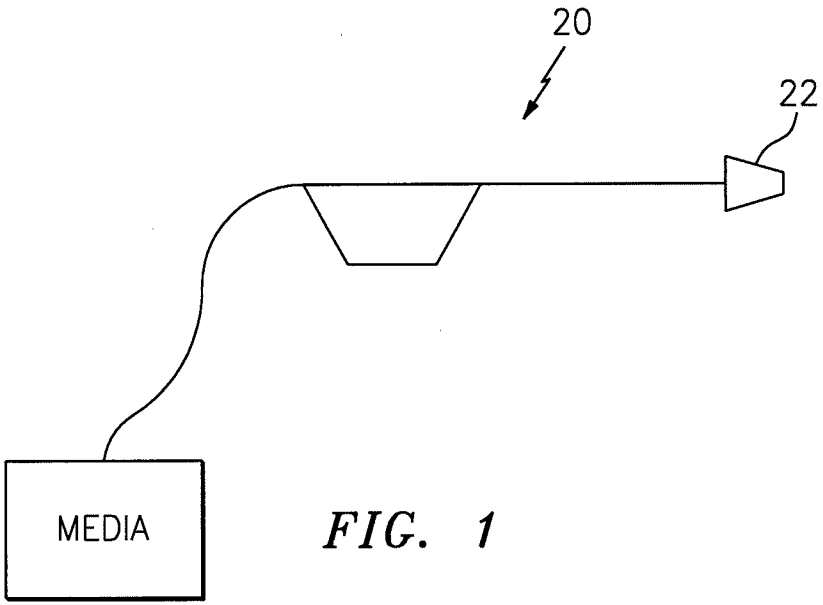
FIG. 1 is a schematic view of a media spray gun.

FIG. 1 schematically illustrates a spray gun 20 with a nozzle 22 such as that manufactured by Empire Abrasive Equipment of Langhorne, Pa. The spray gun 20 may be utilized with, for example only, Aluminum Oxide blasting media which has a blocky shape with multiple, sharp cutting edges that penetrate work pieces, dig-out microchips and leave exceptionally clean etched surfaces. During blasting, Aluminum Oxide blasting media fractures and thereby does not create a dusty atmosphere.

Figure 3:
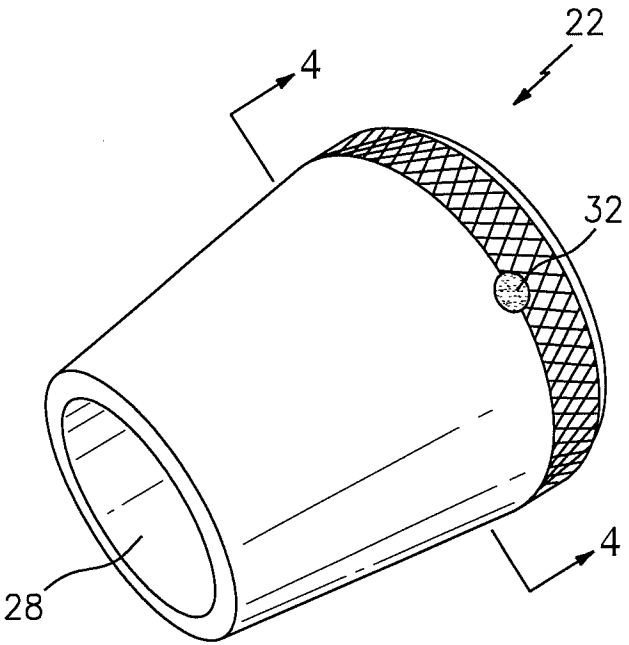
FIG. 3 is an aft perspective view of the nozzle.
Figure 2:
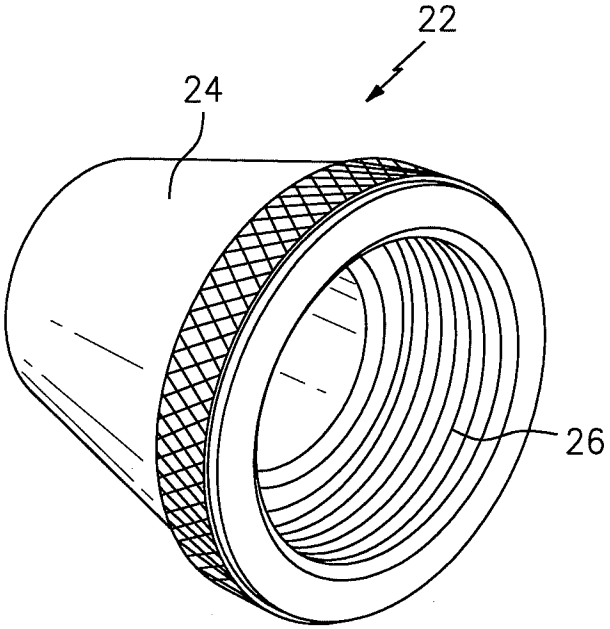
FIG. 2 is a front perspective view of a nozzle for the media spray gun of FIG. 1.

With reference to FIGS. 2 and 3, the nozzle 22 generally includes a body 24 manufactured of a metallic material such as Aluminum and steel (stainless or otherwise) with a set of internal threads 26 manufactured of a non-metallic material such as polypropylene polymers along a nozzle axis A. The nozzle 22, includes but is not limited to, straight-bore, venturi and angle nozzles with respect to the nozzle axis A. The metallic body 24 facilitates tolerance maintenance of the aperture 28 when the media is sprayed therethrough. That is, the aperture 28 is axially forward of the set of internal threads 26 along the axis A and is formed by the metallic body 24 to effectively direct the blasting media within minimal wear thereto.

Figure 4:
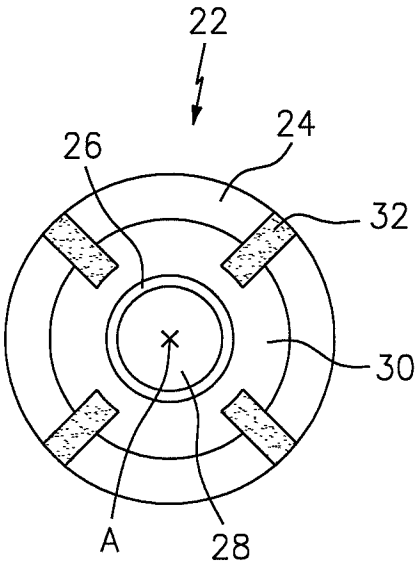
FIG. 4 is a cross-section through the nozzle.

An insert 30 forms the non-metallic set of internal threads 26 axially aft of the aperture 28. That is, the set of internal threads 26 may be formed on the insert 30 and the insert 30 mounted into the metallic body 24. The insert 30 may be a separate component that is retained, for example, with transverse metallic or non-metallic pins 32 transverse to a nozzle axis A (FIG. 4). That is, the pins 32 penetrate the metallic body 24 toward the axis A to extend at least partially into the insert 30 to thereby retain the insert 30. The pins 32 facilitate retention of the insert 30 when the nozzle is threaded and unthreaded from the gun 20. In another disclosed non-limiting embodiment, the insert 30 is directly molded into the metallic body 24.

The non-metallic set of internal threads 26 facilitates removal from the spray gun 20 for normal maintenance and operational checks of wear surfaces yet advantageously directs media such as Aluminum Oxide blasting media through the aperture 28.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A media blast nozzle comprising:
a nozzle body manufactured of a first material with a set of internal threads manufactured of a second material different than said first material,
wherein said second material is a non-metallic material.

2. The media blast nozzle as recited in claim 1, wherein said first material is a metallic material.

3. The media blast nozzle as recited in claim 1, wherein said set of internal threads are retained to said nozzle body by pins.

4. The media blast nozzle as recited in claim 1, wherein said set of internal threads are molded to said nozzle body.

5. The media blast nozzle as recited in claim 4, wherein said first material is a metallic material.

6. The media blast nozzle as recited in claim 1, wherein said set of internal threads are formed by an insert retained to said nozzle body by pins.

7. A media blast nozzle for a spray gun, said media blast nozzle comprising:
a nozzle body manufactured of a first material, said nozzle body defines an axis; and
an insert with a set of internal threads manufactured of a second material different than said first material, said insert located at least partially within said nozzle body.

8. The media blast nozzle as recited in claim 7, wherein said insert is retained to said nozzle body by pins.

9. The media blast nozzle as recited in claim 7, wherein said first material is a metallic material.

10. The media blast nozzle as recited in claim 7, wherein said second material is a non-metallic material.

11. The media blast nozzle as recited in claim 7, wherein said insert is retained to said nozzle body by pins.

12. A media blast nozzle for a spray gun, said media blast nozzle comprising:
a nozzle body manufactured of a first material, said nozzle body defines an axis; and
an insert with a set of internal threads manufactured of a second material different than said first material, said insert located at least partially within said nozzle body; and
a pin that extends through said nozzle body and at least partially into said insert.

13. The media blast nozzle as recited in claim 12, wherein said transverse pin is directed toward said axis.

14. The media blast nozzle as recited in claim 12, wherein said insert is located opposite an aperture of said nozzle body along said axis.

* * * * *